US005353568A

United States Patent [19]

Silva

[11] Patent Number: 5,353,568

[45] Date of Patent: Oct. 11, 1994

[54] WALL AND DOOR REPAIR KIT AND METHOD

[76] Inventor: Gilbert E. Silva, 3325 Fronda Dr., San Jose, Calif. 95122

[21] Appl. No.: 85,884

[22] Filed: Jul. 1, 1993

Related U.S. Application Data

[63] Continuation of Ser. No. 811,655, Dec. 23, 1991, abandoned.

[51] Int. Cl.[5] ..... E02D 37/00

[52] U.S. Cl. ..... 52/514; 220/352

[58] Field of Search ..... 52/514; 220/352, 359, 220/307

[56] References Cited

U.S. PATENT DOCUMENTS 4,807,415 2/1989 Oak ..... 52/514

*Primary Examiner*—Carl D. Friedman
*Assistant Examiner*—Creigton Smith
*Attorney, Agent, or Firm*—Robert Charles Hill

[57] ABSTRACT

A repair kit intended to be used in repairing (in the form of a plug type device) a hole in various types of wall construction and primarily hollow core doors. This repair device is comprised of a specially designed disk so as not to allow the disk to fall into the wall cavity, and a piece of dowel rod. The disk and dowel rod may be made of a multitude of substances, giving special consideration to factors such as bondable surface area, and weight versus mass. The disk is designed to plug a hole in a wall or door, after following some simple wall or door preparation. The disk is held in place by a bonding material such as, spackle or drywall type taping compounds for wall repairs. When used for the repair of a door, it is best to use a wood glue. Once in place the disk surface is covered with plaster, Spackle, drywall compound or whatever material is appropriate for the surface being repaired. When the compound is dry, the area of repair may be sanded smooth to match the existing wall or door surface, then painted, or texture may be added to the surface prior to painting.

6 Claims, 2 Drawing Sheets

WALL AND DOOR REPAIR KIT AND METHOD

This is a continuation of copending application Ser. No. 07/811,655 filed on Dec. 23, 1991 now abandoned.

BACKGROUND OF THE INVENTION

This invention is intended to be used as a wall and door repair kit. The repair kit includes a simple yet specially designed disk, and piece of dowel rod. The kit can easily be used by the average person to repair a hole in a wall or door comprised of most any building material. It is common knowledge that small nail or bolt holes can be repaired (with only one application) by using only Spackle type compound material or the like. Large holes up to possibly one inch in diameter can be repaired by applying small amounts of Spackle type material around the area of the hole in stages, allowing each staged application to dry before applying another. This method could take anywhere from several hours to several days to complete. Even when this method is complete, it is highly doubtful it would last very long. The reason being, the weight of the patch exceeds the bondability of the surface area to which it is bonded. The slightest vibration or pressure against the outside surface could foil the effort. In those cases where a devise which provides pressure against the opposing interior side of the wall, be it crumpled up paper or an inflatable device, the problem is only compounded by that side of the wall providing vibration and/or pressure, causing the bonding material to debond, and consequently become loose and possibly fall into the wall cavity. In either case, becoming unsightly on the previously repaired outside surface of the wall.

Many mechanical and nonmechanical devices of varied designs have been submitted for patents which are intended to be used for repairing walls, and walls and doors. These repairs attempt to be accomplished by means of the devices being inserted into the hole or wall cavity to support a spackling compound type of material patch. Attempts at providing backing for patches in various configurations have also been attempted. These are shown, for example, in U.S. Pat. Nos. 3,226,893; 3,325,955; 3,583,122; 3,690,084; 3,834,107; 3,874,505; 3,936,988; 3,999,347; 4,062,165; 4,075,809 and 4,620,407. There have been other attempts at providing backing for the patch in the form of an inflatable object placed in the interior of the wall cavity such as is U.S. Pat. No. 4,715,151 which proved to be equally as unsuitable or unstable as the others previously listed. None of these repair designs to my knowledge have ever been successfully manufactured and marketed, and utilized by the general public.

SUMMARY AND GENERAL DESCRIPTION OF THIS INVENTION

This invention is designed to overcome all of the problems encountered by prior inventions and to provide a 'REALLY' simple, light weight and inexpensive device for patching a hole in, but not limited to a hollow core door and most any type of constructed interior wall. The components contained within the kit of this invention are simply a specially designed disk and a small piece of dowel rod.

BRIEF DESCRIPTION OF THE DRAWING

The invention is shown in the accompanying drawings for purposes of illustration, and is not intended to limit it to this precise configuration, physical materials or uses.

DETAILED DESCRIPTION OF THE PREFERRED METHOD OF UTILIZATION

Figure 1:
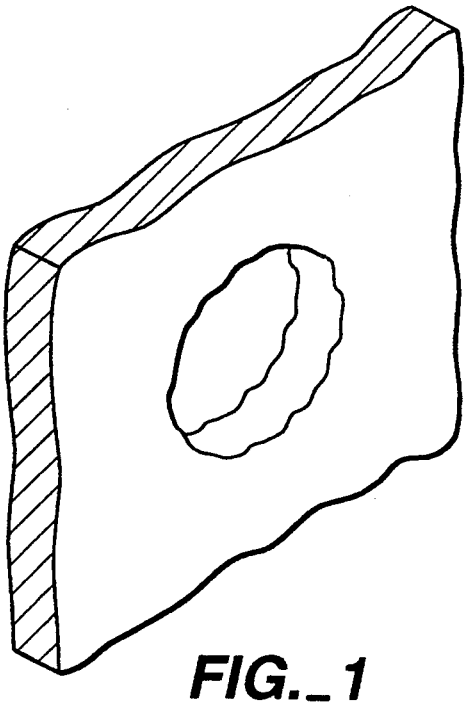
FIG. 1 is a perspective view, showing a jagged hole in a wall or door surface.
Figure 2:
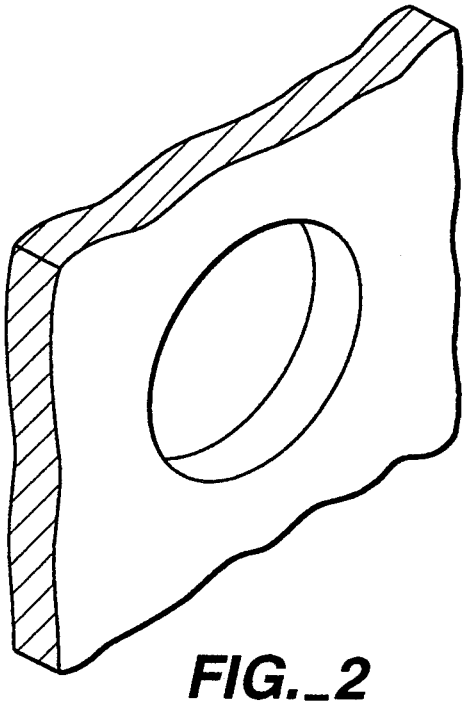
FIG. 2 is a perspective view of that hole in FIG. 1 after having made the perimeter round and smooth.
Figure 3:
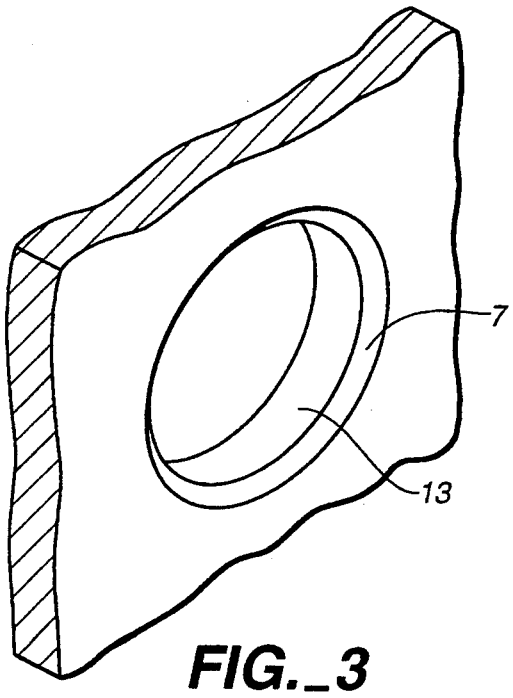
FIG. 3 is a perspective view of that hole in FIG. 2 after having made a bevel completely around the circumference of the hole on the front of the wall surface.
Figure 4:
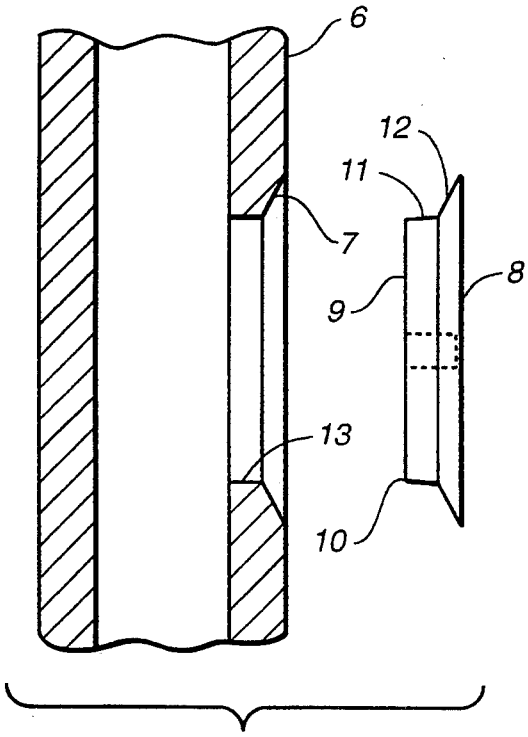
FIG. 4 is a cross-sectional view of a simplified typical wall construction which: a) captures the hole as illustrated in FIG. 3, and b) shows a cross-sectional view of the invention positioned as it would be inserted into the hole.

Herein reference is made to the drawing elements, where the same numbers are used in different alpha figures when indicating pictorially the same elements. Within the drawing is shown a "Plug-a-Hole" TM repair kit consisting of two components: a specially designed round disk 16, FIG. 6, and a dowel rod 15, FIG. 6. The round disk 16 part of the kit is intended to be used to repair holes in but not limited to, walls constructed of but not limited to: wood, wood products, drywall, wallboard, plaster, plasterboard, lath, lath and plaster. The dowel rod 15 part of the kit is intended to be used in the repair of primarily but not limited to hollow core doors made primarily of but not limited to wood and wood by-products.

The round disk 16 and dowel rod 15 may be made of but not limited to wood, wood by-products, various foams, plastics, petroleum and non-petroleum based products, or any combinations thereof. The dimensions of the disk 16 and dowel rod 15 may be various diameters, thickness and lengths. The inventor however, feels the optimum thickness for the disk 16 is $\frac{3}{8}$ to $\frac{3}{4}$ of an inch, depending upon the material it is made from.

The round disk 16 component of the invention was specially designed to:

a) inset only slightly beyond the surface of wall materials surface 6.

b) not make contact with the opposite side of the wall.

c) allow the ability of bonding and compound materials used in installation to dry from both front and back.

d) be light weight while strong, giving full consideration to available surface bonding area with respect to the weight of the repair device.

e) be inserted into a hole without the edge 11 of the disk 16 being an obstacle due to those edges being beveled.

f) provide (after installation) a flat surface to which a compound could be easily applied in no more than two coats (with sanding after each coat), making the compound surface flush with the wall surface 6.

g) seat securely in the wall material without falling into the wall cavity due to beveled surface 12.

h) give the maximum bonding surface, area 11 and 12.

i) provide maximum bonding surface and bondability of the surfaces 8, 9, 11 and 12 due to the dimensions, methods, and materials from which it is made.

When repairing a hole in a wall:

The round disk 16 installation is accomplished by:

a) placing the disk 16 (of appropriate size) over a jagged hole of a wall surface 6 with the inside face 9 against the wall surface 6.

b) using a pencil or pen, draw a line on surface 6 using the edge 10 of the disk 16 as a template.

c) using a keyhole type saw, (or some such other cutting device) cut around the outside circumference of the line drawn on surface 6, such that the line can barely be seen on the cutout piece of the wall material surface 6.

d) using a drywall knife (or some such other cutting device) bevel the outermost perimeter edge of the wall surface 6 where it will make contact with the beveled edge 12 surface of the disk 16. The surface 8 of the disk 16 should be slightly below the surface 6 of the wall material.

e) check for fit of surfaces 6, 7, and 13 with disk 16 surfaces 8,11 and 12, and carefully make adjustments to the cut wall material surfaces 7 and 13 until the entire circumference of the disk surface 8 is "ONLY" slightly below the wall surface 6 when correctly done.

f) blow or vacuum all cut surfaces of the wall material surface 6, 7 and 13 to remove loose dust and particles of wall material.

g) apply drywall compound (or plaster, or whatever material is appropriate) in liberal amounts to disk surfaces 11 and 12, and the cut wall material surfaces 7 and 13.

h) carefully insert the disk 16 into the prepared hole in wall material, and press firmly into place such that surface 8 of the disk is slightly below the wall surface 6.

i) using a wide Spackle knife, level any compound between wall surface 6 area and disk surface 8 area, and allow 20 to 30 minutes for compound to set (or whatever manufacturer's instructions suggest for the material being used). It is not necessary to allow the compound to completely dry at this stage of the installation, but simply set up.

j) apply a coating of compound (or whatever material is appropriate) to the surface 8 area of the disk 16 such that it is completely flush with the wall surface 6 area, and allow to dry completely (per whatever the compound material manufacturer's recommendations).

k) sand those surface areas 6 and 8 where compound material was applied to cause the repaired area to be flush with the wall surface 6 area.

l) vacuum or wipe (using a clean dry cloth) dust from repaired area. Duplicate steps j through l as required, although it should not require more than a second coat of compound material and final sanding to complete the repair. Now the repaired area is ready to apply whatever is required to match the rest of the existing wall surface.

Figure 5:
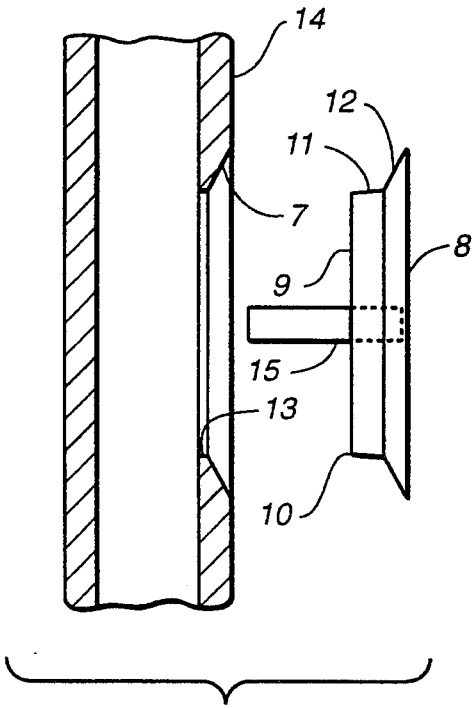
FIG. 5 is a cross-sectional view of a simplified typical door construction, which: a) captures the hole as illustrated in FIG. 3, and b) shows a cross-sectional view of the invention positioned as it would be inserted into the hole.
Figure 6A:
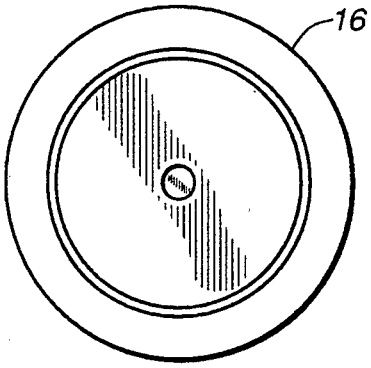
FIG. 6 is two different views of the disk and one dowel rod. This is a representation of the "Kit".
Figure 6B:
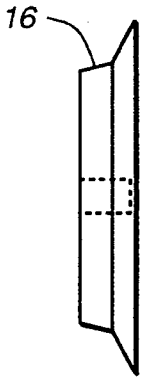
Figure 6C:
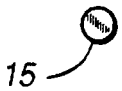
Figure 6D:
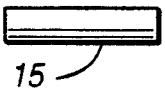

When repairing a hole in a door:

The dowel rod 15 is intended to be used when repairing a hollow core door (see FIG. 5 of drawing), and in conjunction with the disk 16. The door would then most likely be painted. This application of the invention would be almost exactly as that of the use for repairing a hole in a wall. For use in repairing a hole in a door, the round disk 16 installation is accomplished by:

a) placing the disk 16 (of appropriate size) over a jagged hole of a door surface 14 with the inside face 9 against the door surface 14.

b) using a pencil, draw a line on surface 14 using the edge 10 of the disk 16 as a template.

c) using a 'fine tooth' keyhole or jig type saw, (or some such other cutting device) cut around the inside circumference of the line drawn on surface 14, such that the line can barely be seen on the door material surface 14.

d) using a wood file (or some such other fine cutting device) bevel the perimeter edge of the door surface 14 where it will make contact with the beveled edge 12 surface of the disk 16. The surface 8 of the disk 16 should be only slightly below the surface 14 of the door material when done correctly.

e) check for fit of surfaces 7, 13, and 14 with disk 16, against surfaces 8, 11 and 12, and carefully make adjustments to the cut door material surfaces 7 and 13 until the entire circumference of the disk surface 8 is "only" slightly below the door surface 14.

f) blow or vacuum all cut surfaces of the door material surface 7, 13 and 14 to remove loose dust and particles of door material.

g) apply glue to one end of the dowel rod 15 and insert that end (approximately ⅛ inch) into the hole provided in disk 16, surface 9.

h) while the glue on the dowel rod is still wet, place disk 16 into the prepared hole in door surface 14 and press gently but firmly into place. This will force the dowel rod 15 into the hole (provided) in the disk 16 by pressing the dowel rod 15 against the opposite side of the door surface.

i) remove the disk 16 with the now preset length of the dowel rod 15 glued in place into the disk 16. Place a drop of glue on the exposed end of the dowel rod 15, also apply glue to surfaces 7 and 13 of door surface 14 and surfaces 11 and 12 of disk 16.

j) into the now prepared hole of the door, insert disk 16 and press gently but firmly into place.

k) while holding in place wipe off excess glue with a clean dry cloth or tissue and continue holding in place while applying a couple of small pieces of masking tape at the edges of mating surfaces 8 and 14 to secure disk 16 while glue drys.

l) allow glue to dry per the glue manufacturer's instructions.

m) apply a coating of drywall type compound (or whatever material is appropriate) to the surface 8 area of the disk such that it is completely flush with the door surface 14 area, and allow to dry completely (per whatever the compound material manufacturer's recommendations).

n) sand those surface areas 8 and 14 where compound material was applied to cause the repaired area to be flush with the door surface 14 area.

o) vacuum or wipe (using a clean dry cloth) dust from repaired area. Duplicate steps 'm' through 'o' as required, although it should not require more than a second coat of compound material and final sanding to complete the repair. Now the repaired area is ready for whatever is required to match the rest of the existing door surface.

This proposed invention could be embodied in other similar forms without departing from the spirit of essential attributes thereof and therefore reference should be made to the section of this document headed "CLAIMS" as well as the foregoing specification as indicating the scope of the invention. It is to be understood, the aforementioned described configurations are illustrative of the application of the principles of this invention. Similar arrangements may be devised by those skilled in the art without departing from the spirit and scope of the invention. For example, the disk could be square, oblong or of any other suitable configuration.

I claim:

1. A repair kit for repairing a hole in the surface of a double panel door having front and rear panels comprising;

said repair kit having a first flat surface opposite a second flat surface with a boundary surface therebetween;

said boundary surface having a first area forming a first angle with said first surface, and a second area forming a second angle with said second surface;

said first angle being acute;

said second angle being obtuse;

said areas meeting along a line that is between said first and second surface, a dowel having a length and two ends;

said second flat surface having a recess hole for securingly engaging one end of said dowel; and said dowel having a length such that when one end of said dowel is inserted in said recess hole in said second flat surface and said repair kit is positioned in said hole in said front door panel with said first surface of said kit flush with an outside of said front door panel, the other end of said dowel abuts said rear door panel.

2. A repair panel as in claim 1 wherein said panel is made of material that is selected from the group that consists of wood and fiber board.

3. A repair panel as in claim 1 wherein said first and second surfaces are circles.

4. A repair panel as in claim 1 wherein said first and second surfaces have a rectangular shape.

5. A repair panel as in claim 1 which comprises a bonding agent adapted for application on said boundary surface.

6. A method for repairing a hole in a wall which includes the following steps:

(a) selecting a repair panel, said repair panel having a first flat surface opposite a second flat surface and a boundary surface therebetween having a first area forming a first angle with said first surface, and a second area forming a second angle with said second surface, said first angle having an angle that is approximately forty five degrees, said second angle having an angle that is approximately ninety three degrees, said first and second surfaces having a shape and dimension to cover said hole in said wall;

(b) laying said repair panel against said wall to cover said hole;

(c) tracing around said first surface with a means for marking to leave a drawing of said first surface on said wall with said hole positioned within said drawing;

(d) cutting around said drawing thereby providing a prepared hole and a prepared hole surface around an edge of said prepared hole for receivingly engaging said repair panel in said prepared hole such that, when said repair panel is placed in said prepared hole said first surface can be slightly inserted in said prepared hole;

(e) removing all loose material from said edges of said hole;

(f) applying a bonding agent to said boundary surface of said panel and said prepared hole surface;

(g) inserting said repair panel into said prepared hole and pressing said repair panel firmly into place such that said first surface is set in said hole;

(h) leveling any bonding agent in a region adjacent to said first surface of said disk so as to generate a region surface coplanar with said wall surface;

(i) applying a coating of bonding agent to said region surface and said wall surface proximal to said region surface; and (j) sanding said region surface and said adjacent area of said wall surface.

* * * * *